US005908651A

United States Patent [19]

Gustavsson et al.

[11] Patent Number: 5,908,651

[45] Date of Patent: Jun. 1, 1999

[54] PRODUCT RECOVERY SYSTEM AND METHOD

[75] Inventors: Stig Gustavsson, Kenosha; Keith Koberstein, Milwaukee, both of Wis.

[73] Assignee: Tetra Laval Holdings & Finance, SA, Pully, Switzerland

[21] Appl. No.: 08/975,083

[22] Filed: Nov. 20, 1997

[51] Int. Cl.[6] ..... B65B 55/00; B65B 31/02

[52] U.S. Cl. ..... 426/399; 426/412; 426/521; 53/432; 53/433; 53/467

[58] Field of Search ..... 426/399, 397, 426/521, 412; 53/432, 433, 467

[56] References Cited

U.S. PATENT DOCUMENTS

| | | | |
|---|---|---|---|
| 0,580,169 | 4/1897 | Washington | 96/188 |
| 1,095,463 | 5/1914 | Kieser | 96/188 |
| 1,727,733 | 9/1929 | Stovall | 96/188 |
| 2,428,044 | 9/1947 | Sharp et al. | 426/487 |
| 2,713,973 | 7/1955 | Hencken et al. | 237/63 |
| 2,738,852 | 3/1956 | Freneau et al. | 96/206 |
| 2,772,979 | 12/1956 | Graves | 426/487 |
| 3,018,184 | 1/1962 | Martin | 426/399 |
| 3,200,568 | 8/1965 | McNeil | 55/191 |
| 3,232,770 | 2/1966 | Schank et al. | 426/399 |
| 3,368,330 | 2/1968 | Elliott et al. | 55/193 |
| 3,891,779 | 6/1975 | Robinson | 426/399 |
| 3,973,048 | 8/1976 | Sollerund | 426/522 |
| 4,023,941 | 5/1977 | Miller | 55/169 |
| 4,087,261 | 5/1978 | Hays | 55/41 |
| 4,210,176 | 7/1980 | Emming | 137/573 |
| 4,343,630 | 8/1982 | Grant | 55/170 |
| 4,419,301 | 12/1983 | Nahra et al. | 261/118 |
| 4,486,203 | 12/1984 | Rooker | 55/174 |
| 4,560,564 | 12/1985 | Bruno, Jr. et al. | 426/250 |
| 4,637,936 | 1/1987 | White et al. | 426/523 |
| 4,684,531 | 8/1987 | Torterotot | 426/399 |
| 4,755,194 | 7/1988 | Rooker et al. | 55/52 |
| 4,853,246 | 8/1989 | Stevens | 426/580 |
| 4,872,919 | 10/1989 | Bucher et al. | 134/3 |
| 4,876,100 | 10/1989 | Holm et al. | 426/491 |
| 5,020,303 | 6/1991 | Vokins | 53/432 |
| 5,085,882 | 2/1992 | Rausing | 426/524 |
| 5,141,756 | 8/1992 | Bajracharya et al. | 426/46 |
| 5,242,701 | 9/1993 | Poole | 426/407 |
| 5,261,282 | 11/1993 | Grabowski et al. | 73/86.01 |
| 5,308,384 | 5/1994 | Kapanen et al. | 95/260 |
| 5,403,475 | 4/1995 | Allen | 210/168 |
| 5,405,435 | 4/1995 | Beckedam | 96/158 |
| 5,443,857 | 8/1995 | Arph et al. | 426/522 |
| 5,494,691 | 2/1996 | Sizer | 426/392 |
| 5,503,064 | 4/1996 | Scheel et al. | 99/453 |
| 5,514,389 | 5/1996 | Nikdel et al. | 426/231 |
| 5,804,240 | 9/1998 | Madlener | 426/410 |

FOREIGN PATENT DOCUMENTS

| | | |
|---|---|---|
| 0337010 | 4/1988 | European Pat. Off. . |
| 5697508 | 1/1980 | Japan . |
| 593908 | 8/1982 | Japan . |
| 61157321 | 12/1984 | Japan . |
| 1608409 | 12/1987 | Russian Federation . |

*Primary Examiner*—Nina Bhat
*Attorney, Agent, or Firm*—Michael A. Catania

[57] ABSTRACT

A recovery system for a hot fill system. The hot fill system has a first diverter for diverting the flow of overflow product from a product tank to a filler feed tank. The system also has a source of compressed air for clearing the line between the overflow tank and the product tank. The system also has a source of water for clearing the line from the product tank to the filler feed tank. The system also has a heater for reheating overflow product with a recirculation/recovery loop. The system allows for the recovery of product which would have been lost during a hot fill product run.

20 Claims, 3 Drawing Sheets

PRODUCT RECOVERY SYSTEM AND METHOD

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to hot fill processing systems for liquid food products. More specifically, the present invention relates to a product recovery system for a hot fill pasteurization system.

2. Description of the Related Art

Liquid food products are packaged in a variety of containers such as polyethylene terephthlate ("PET") bottles, blow molded high density polyethylene ("HDPE") jugs, gable-top cartons, glass bottles, aluminum cans, pouches and parallelepiped containers (e.g. the TETRA BRIK® package). Liquid food products include fruit juices, sports drinks, tea, milk, soft drinks, and the like. It has become commonplace to have more shelf stable products and extended shelf life ("ESL") products. A shelf stable product is defined as a product that may be stored without refrigeration for up to three months while an ESL product is defined as one that may be stored with refrigeration for up to four months. The popularity of these products with retailers is due to the extended amount of time that the product may be "marketed" to the consuming public without spoilage.

In order to obtain ESL and shelf stable products, the liquid food product most be processed in a manner that renders the product essentially free of micro-organisms and microbial growth. Several methods are utilized to process products in this manner. One such process is a hot fill pasteurization process.

Basically, a hot fill pasteurization process is a continuous flow through processing system which heat treats the product to kill micro-organisms . The product is then directed to a container filling machine which fills the product into a container at an elevated temperature (hot fill). The heat treatment and the hot fill render the product shelf stable.

In a typical hot fill pasteurization system, a product such as fruit juice is pumped from an external storage tank to a primary balance tank as needed to maintain a constant level in the primary balance tank. The product is continually pumped from the primary balance tank through a product heater, then through a holding loop, then through a product cooler and to a filler feed tank. The heater typically uses hot water to heat to heat the product to an elevated temperature, usually 87° C. to 119° C. (190° F. to 245° F.). The holding loop maintains the product at this elevated temperature for a predetermined time period necessary to kill the micro-organisms. The predetermined time period will vary depending on the product. The cooler uses cold water to cool the temperature of the product to a hot fill temperature. For example, for a PET bottle, the hot fill temperature is 85° C. (185° F.) which is just below the softening temperature of the PET bottle. Hot filling containers maximizes shelf life by killing organisms on the container surface, and also assists in vacuum sealing of the container.

At the filler feed tank, the product is pumped to a filler where most of the product is filled into containers. A portion of the product overflows from the filler into a filler overflow tank or return tank. The overflow product from the filler is approximately 5% to 25% of the total product fed to the filler when the filler is filling containers and 100% when containers are not being conveyed through the filler. The latter scenario occurs during priming of the processing system or during shut-down of the system. Overflow product from the filler overflow tank is pumped to the main balance tank where it joins fresh product feeding into the system. In this manner the overflow product is processed through the entire cycle again.

Once a product batch is completed, the product remaining in the system is rendered excess product. This remaining product is either in the overflow tank, in the primary balance tank or in the sterilization portion of the system (the heater and cooler). Current practice is to dispose of the excess product or to transfer it to a separate tank where the products value is greatly diminished. Depending on the product and processing system, this excess product could account for 25% to 100% of the system hold-up volume.

BRIEF SUMMARY OF THE INVENTION

One aspect of the present invention is a system for recovering excess product undergoing hot fill processing. The system creates a recovery/recirculation loop within the system thereby allowing for the processing of product that would have been wasted in the prior art. The loop includes a filler feed tank, a filler, an overflow tank, a diverter and a heater.

Another aspect of the present invention is a method for recovering product in a hot fill system. The method includes the steps of diverting the flow to create the recovery/recirculation loop, clearing the system with water or some other evacuating medium, and clearing an overflow line with compressed air. The method may also include heating the diverted product.

It is a primary object of the present invention to provide a system and method for recovering excess product from a hot fill processing system.

It is an additional object of the present invention to provide a method and system for reheating excess product pumped directly from an overflow tank to a filler.

It is yet another object of the present invention to provide a method and system for minimizing the waste of product during hot fill processing.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which:

There is illustrated in FIG. 1 a schematic diagram of a preferred system of the present invention;

Figure 2:
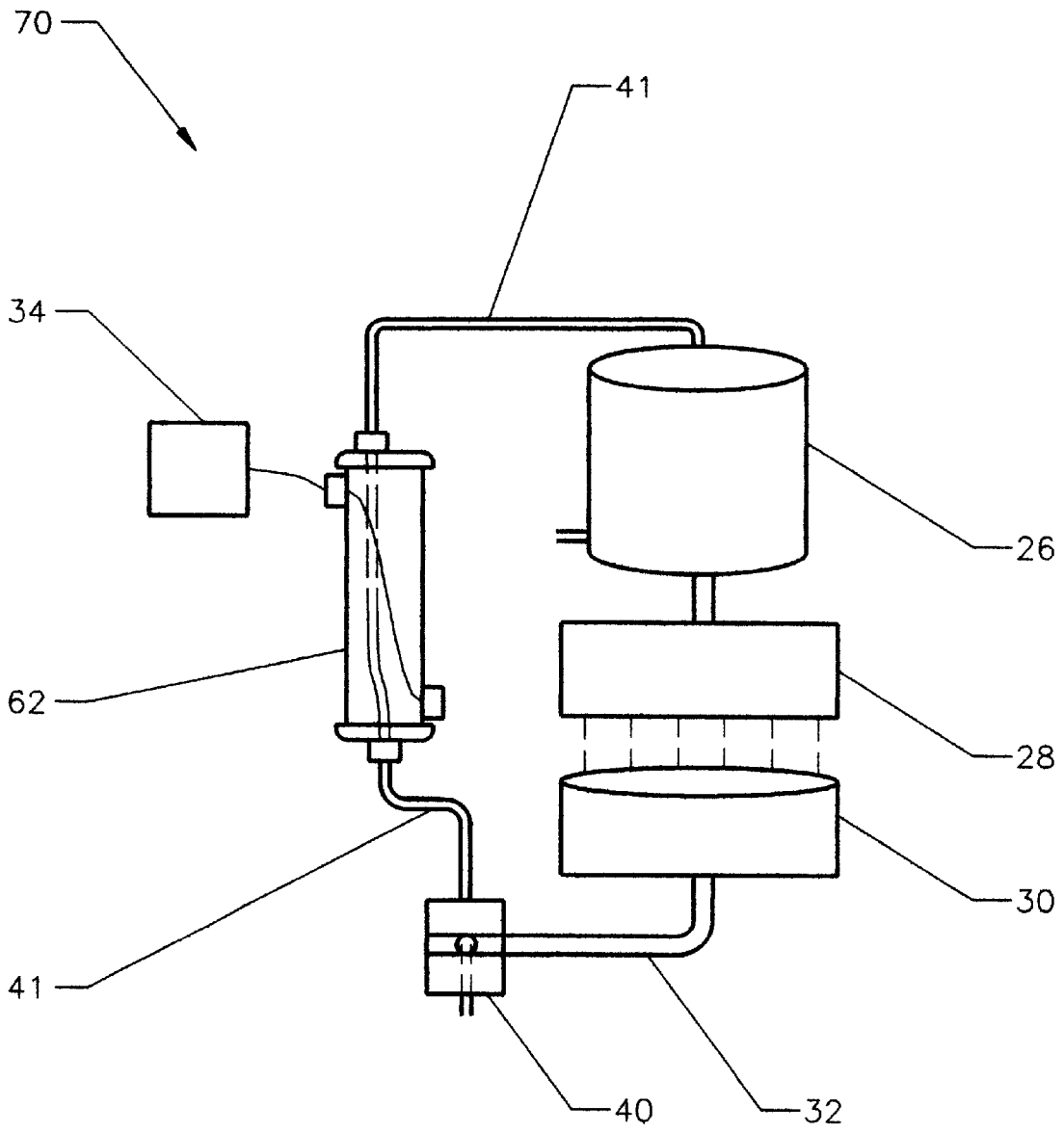
Figure 3:
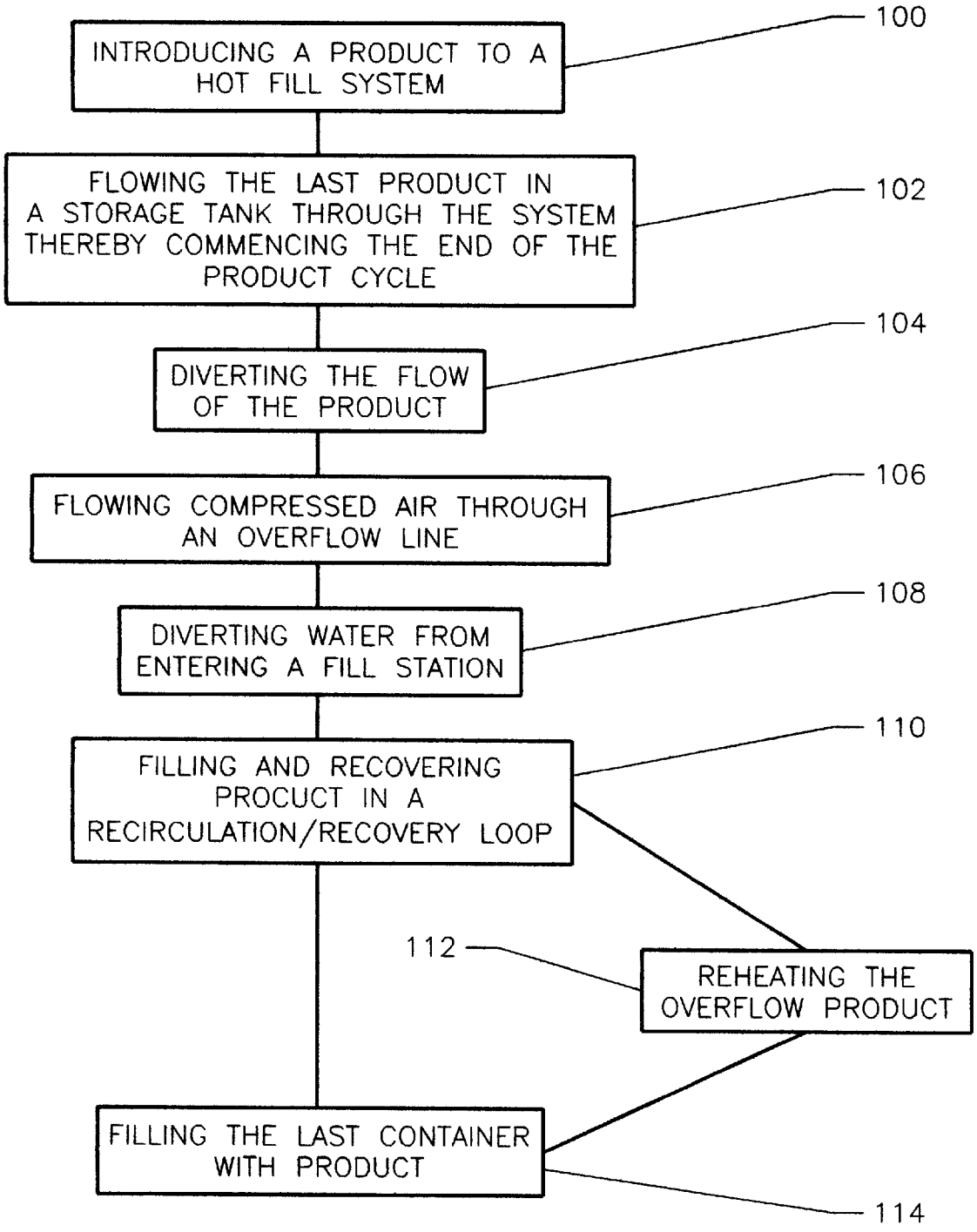

There is illustrated in FIG. 2 a schematic diagram of a recirculation/recovery system of the present invention;

There is illustrated in FIG. 3 a flow diagram of a method of the present invention.

DETAILED DESCRIPTION OF THE INVENTION

Figure 1:
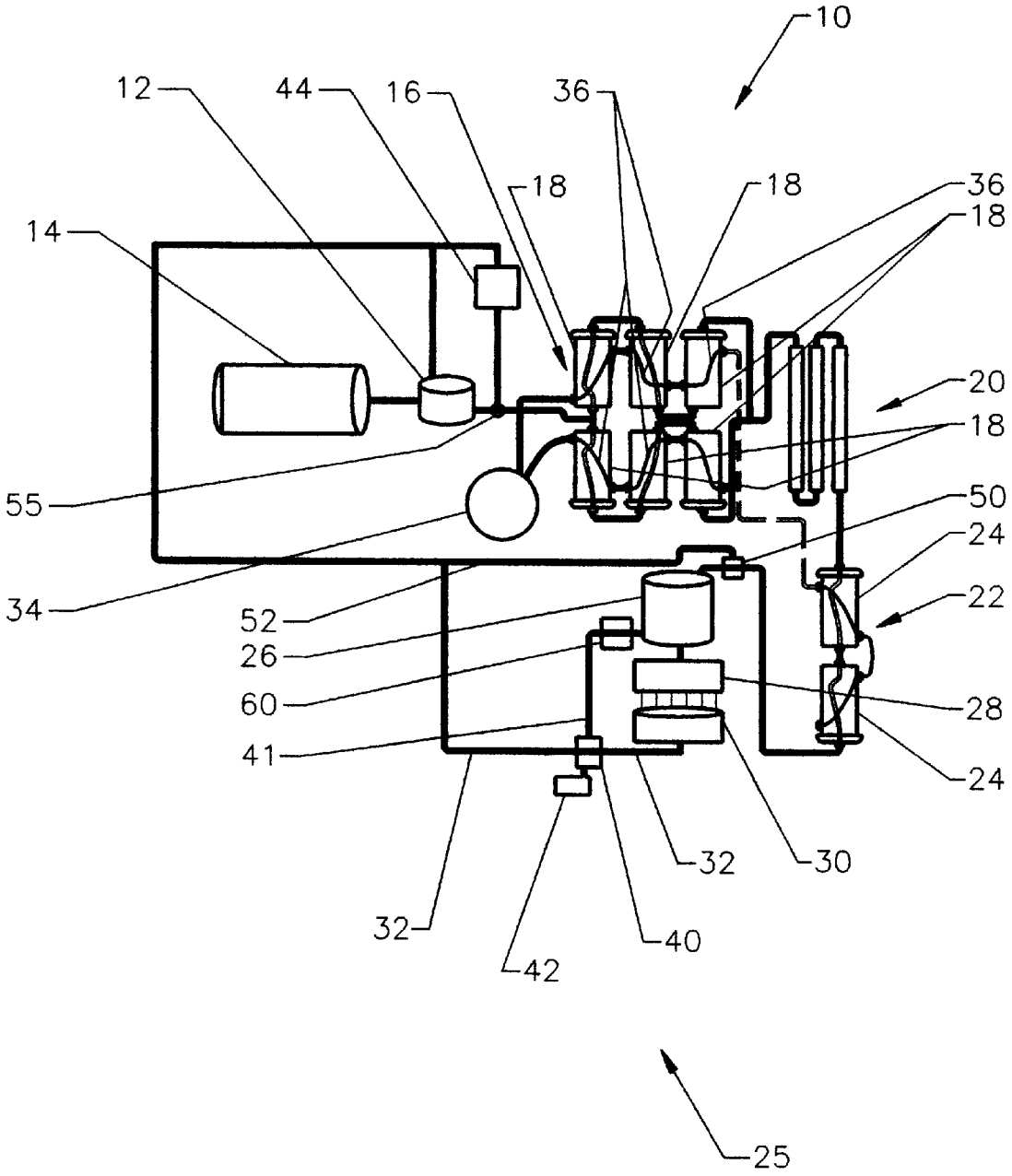

There is illustrated in FIG. 1 a schematic diagram of a preferred system of the present invention. As shown in FIG.

1, a hot fill processing system 10 capable of processing a product begins with a primary balance tank 12 which is continually supplied during processing by an external storage tank 14. A typical product run may be 400 to 600 gallons, and a bottler may make many different product runs in a day. Depending on the procedure, the present invention may save from 50 to 400 gallons of any product run. The primary balance tank 12 is in flow communication with a heating station 16. The heating station 16 may include a series of heaters 18. The heating station 16 elevates the temperature of the product to a particular predetermined temperature, with a preferred temperature range being 87° C. to 119° C. (190° F. to 245° F.). A preferred heater is a SPIRAFLO™ heater available from Tetra Pak, Incorporated of Chicago, Ill. The number of heaters 18 will vary with each particular product depending on the viscosity and thermal conductivity of the product.

The heating station 16 is in flow communication with a holding loop 20. The holding loop 20 maintains the product at the predetermined temperature for a predetermined time period in order to kill micro-organisms within the product. For example, apple juice may be held at 205 to 210° F. for a time period of 6 seconds. However, each bottler and each product may require or desire variations of time and temperature. From the holding loop 20, the product flows to a cooling station 22. The cooling station has a series of heat exchangers 24 which cool the product to a hot fill temperature. The hot fill temperature is dependent on the product and more importantly on the container the product is to be filled into further down the line. For example, if the container is a PET bottle, then the hot fill temperature is 85° C. (185° F.). Other containers such as glass bottles, aluminum cans and the like may be filled under a similar system with similar temperatures. The heating station 16, the holding loop 20 and the cooling station 22 comprise the sterilization section of the system.

From the cooling station 22, the product is pumped to a filling station 25. At the filling station 25, the product is first pumped to a filler feed tank 26 which then directs the product to a filler 28. The filler 28 has a series of containers which are conveyed to the filler 28 for filling with the product. Once the containers are filled with the product, the containers are sealed and prepared for distribution. As previously mentioned, the containers are hot filled for sterilization purposes. During filling, the overflow product may be 5% to 25% of the total product pumped to the filler 28. This overflow or excess product is recovered in an overflow tank 30. During filling, the overflow product is pumped from the overflow tank 30 through an overflow line 32 to the primary balance tank 12 where the overflow product is added to new product to be processed through the cycle again.

A hot water source 34 may be used to provide heated water to the heating station 16. The hot water circulates through each of the heaters 18 via a hot water line 36. The spent hot water may then be pumped to the cooling station 22 for use in cooling the product.

At the end of a product run or when a particular product is exhausted, the system 10 still has a large quantity of product within its piping. As mentioned previously, the prior practice considered this product lost and unrecoverable. A certain amount of this lost product is attributable to priming while a substantial portion is attributable to overflow product. To make use of this lost product within the system 10, the system 10 must be able to pump this lost product to the filling station 25 while maintaining the temperature requirements, and without using new product to convey the lost product through the system 10.

An overflow line diverter 40 disposed along the overflow line 32 allows for the overflow product flow from the overflow tank 30 to the primary balance tank 12 to be diverted to the filler 26 at the end of a production run. The filler 26 is in flow communication with the diverter 40 through an ancillary overflow line 41. The diverter 40 prevents further overflow product from being pumped to the primary balance tank 12 and instead pumps it directly to the filler creating a post processing recovery cycle which is described in more detailed and further illustrated in reference to FIG. 2. A source of compressed air 42 is also associated with the diverter 40. When the overflow line 32 is diverted to the ancillary overflow line 41, overflow product is still within the overflow line 32 between the diverter 40 and the primary balance tank 12. To evacuate this overflow product from the overflow line 32, compressed air from the source of compressed air 42 is blown through the overflow line 32. The compressed air drives the overflow product to the primary balance tank 32 thereby allowing the overflow product to be reprocessed and clearing the overflow line 32.

To deliver the remaining product in the primary balance tank 12 to the filler, an evacuating medium is introduced to the primary balance tank 12. In a preferred embodiment, the evacuating medium is water which is at a source of water 44. The water, or other evacuating medium, is introduced just subsequent, at point 55 to the primary balance tank 12, at a time immediately subsequent to the emptying of the product from the tank 12. The flow of lost product through the system 10 is thus uninterrupted due to the water. The water enables the flow of lost product through the heating station 16, through the holding loop 20, through the cooling station 22 and into the filling station 25. Prior to the water, or other evacuating medium, entering the filling station 25, a filling station diverter 50 diverts the water, or other evacuating medium, from the filling station 25 to the water source 44 via a water source line 52. A preferred diverter is a SRC valve available from G&H Products Corp of Pleasant Prairie, Wis. Several methods may be used to determine when to divert the flow from the filler 25. A preferred method is a flowmeter which tracks the amount of water, distance and time. Other methods of time and temperature are also available for use in tracking the flow of evacuating medium or water. Thus, all of the lost product has been pumped or otherwise delivered to the filling station 25.

In the filling station 25, a self-contained product circulation loop has been established with the overflow product from the overflow tank 30 returned directly to the filler feed tank 26 after passing through a retreatment complex 60 which is further described below in reference to FIG. 2.

As shown in FIG. 2, the recirculation/recovery system 70 is composed of the filler feed tank 26, the filler 28, the overflow tank 30, the diverter 40, the ancillary overflow line 41 and the retreatment complex 60 which as shown is a heater 62. However, the retreatment complex 60 may include further processing equipment such as coolers, additive introducers and the like. However, the preferred embodiment as shown has only a heater 62 for increasing the temperature of the overflow product due to the possibility that during the filling process the overflow product may have cooled a few degrees from the hot fill temperature. The recirculation/recovery cycle is repeated until substantially all of the product is recovered and filled into containers. A small quantity of product may remain in the recirculation/recovery system 70, however, the introduction of compressed air along the cycle may even further the recovery.

There is illustrated in FIG. 3 a flow diagram of the method of the present invention which will be referenced to the system described in FIG. 1. At step 100, a product to undergo hot fill processing is introduced into a hot fill processing system. The product may be introduced into the primary balance tank 12. The product is heated to a predetermined temperature. The heating may take place at the heating station 16. The product is then held for a predetermined amount of time at the predetermined temperature in a holding loop to effectuate sterilization of the product. The product is cooled to a hot fill temperature. The product is hot filled into a container in order to effectuate sterilization of the container surfaces. The product may be hot filled at the filling station 25 with overflow product being captured by the overflow tank 30. The overflow product is returned to the primary balance tank 12 via the overflow line 41. At step 102, the product run is almost complete thereby creating the potential for lost product as described above. At step 104, the flow of overflow product from the overflow tank to the primary balance tank is diverted to the filler feed tank. At step 106, compressed air is flowed through the overflow line 41 to clear the line 41. At step 108, water is introduced subsequent to the primary balance tank 12 to assist in delivering the lost product in the system 10 to the fill station 25. At step 108, the water is diverted just prior to entering the fill station 25. At step 110, the lost product is filled, recovered and recirculated within a closed recirculation/recovery system within the system 10. At ancillary step 112, the lost product within the closed recirculation/recovery system is reheated to a predetermined hot fill temperature. At step 114, the last container is filled with lost product.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims:

We claim as our invention:

1. A hot fill system for filling a product into a package, the hot fill system comprising:

a product tank for holding the product;

a sterilizing section in flow communication with the product tank;

a filler feed tank in flow communication with the sterilizing section on one end and a filler on the other end; and an overflow tank receiving the overflow product from the filler, the overflow tank in flow communication with the product tank through an overflow line, the overflow tank having a first diverter for diverting flow from the overflow line to the filler feed tank, the overflow line in flow communication with a source of air for clearing the overflow line.

2. The hot fill system according to claim 1 further comprising a heater disposed between the first diverter and the filler feed tank, the heater elevating the temperature of the overflow product.

3. The hot fill system according to claim 1 wherein the a source of water is in flow communication with the hot fill system subsequent to the product tank for clearing product from the hot fill system, and the hot fill system further comprising a second diverter for diverting the flow from the sterilizing section to the filler feed tank.

4. The hot fill system according to claim 1 wherein the sterilization section comprises at least one heater, a holding loop and at least one cooler.

5. The hot fill system according to claim 1 wherein the product is selected from the group of juice, tea and isotonic sports drinks.

6. The hot fill system according to claim 1 wherein the package is selected from PET bottles, glass bottles and aluminum cans.

7. The hot fill system according to claim 1 wherein the non-refrigerated shelf life of product processed through the system is at least forty days.

8. A recovery system for a hot fill system for a beverage product, the hot fill system having a product tank in flow communication with a sterilizing section in flow communication with a filler feed tank in flow communication with a filler, and a filler overflow tank in flow communication with the product tank through a overflow line, the recovery system comprising:

a first diverter line between the filler overflow tank and the filler feed tank, the diverter line diverting the flow from the filler overflow tank to the filler tank;

a source of compressed air for clearing the overflow line;

a source of water in flow communication with the hot fill system subsequent to the product tank; and a second diverter line between the sterilizing section and the filler feed tank, the second diverter line diverting the flow from the sterilizing section away from the filler feed tank.

9. The recovery system according to claim 8 further comprising a heater disposed between the first diverter line and the filler feed tank, the heater elevating the temperature of the overflow product.

10. The recovery system according to claim 8 wherein the sterilization section comprises at least one heater, a holding loop and at least one cooler.

11. The recovery system according to claim 8 wherein the product is selected from the group of juice, tea and isotonic sports drinks.

12. The recovery system according to claim 8 wherein the package is selected from PET bottles, glass bottles and aluminum cans.

13. The recovery system according to claim 8 wherein the non-refrigerated shelf life of product processed through the system is at least forty days.

14. A method for recovering product from a hot fill system for a beverage product, the hot fill system having a product tank in flow communication with a sterilizing section in flow communication with a filler feed tank in flow communication with a filler, and a filler overflow tank in flow communication with the product tank through a overflow line, the method comprising:

diverting the flow of product from the overflow tank to the filler feed tank;

introducing water subsequent to the product tank when substantially all of the product is removed from the product tank;

clearing the sterilizing section with water; and diverting water from the sterilizing section prior to introduction to the filler feed tank.

15. The method according to claim 14 further comprising flowing compressed air through the overflow line to clear the overflow line of product.

16. The method according to claim 14 further comprising heating the product diverted from the overflow tank to the filler feed tank.

17. The method according to claim 16 wherein heating the product is accomplished by a heater disposed between a diverter and the filler feed tank.

18. The method according to claim 14 further comprising filling a container with the diverted product.

19. The method according to claim 14 wherein the product is selected from the group of juices, teas and isotonic sports drinks.

20. The method according to claim 14 wherein the non-refrigerated shelf life of product processed through according to the method is at least forty days.

* * * * *